US007610669B2

(12) United States Patent
Keidel et al.

(10) Patent No.: US 7,610,669 B2
(45) Date of Patent: Nov. 3, 2009

(54) METHOD FOR PRODUCING AN INTEGRATED MONOLITHIC ALUMINUM STRUCTURE AND ALUMINUM PRODUCT MACHINED FROM THAT STRUCTURE

(75) Inventors: Christian Joachim Keidel, Montabaur (DE); Alfred Ludwig Heinz, Niederahr (DE)

(73) Assignee: Aleris Aluminum Koblenz GmbH, Koblenz (DE)

( * ) Notice: Subject to any disclaimer, the term of this patent is extended or adjusted under 35 U.S.C. 154(b) by 0 days.

(21) Appl. No.: 10/787,257

(22) Filed: Feb. 27, 2004

(65) Prior Publication Data

US 2004/0211498 A1 Oct. 28, 2004

Related U.S. Application Data

(60) Provisional application No. 60/456,253, filed on Mar. 21, 2003.

(30) Foreign Application Priority Data

Mar. 17, 2003 (EP) ..... 03075764

(51) Int. Cl.
*B23P 25/00* (2006.01)
*C22F 1/04* (2006.01)

(52) U.S. Cl. ..... 29/527.4; 29/557; 29/558; 29/890.01; 29/897; 148/690; 148/694; 420/532; 420/533; 420/537; 420/538; 420/546; 420/547

(58) Field of Classification Search ..... 29/527.4, 29/527.6, 557, 558, 890.01, 897; 148/417, 148/439, 552, 692, 690, 694; 420/529, 531, 420/532, 533, 537, 538, 546, 547, 543, 545; 72/333, 334, 340

See application file for complete search history.

(56) References Cited

U.S. PATENT DOCUMENTS 3,331,711 A * 7/1967 Auvo et. al. ..... 148/577
3,540,252 A * 11/1970 Pfanner ..... 72/166

(Continued)

FOREIGN PATENT DOCUMENTS

EP 0829552 3/1998

(Continued)

OTHER PUBLICATIONS

Boeing Material Specification (BMS) 7-323D "High Strength Fatigue Tolerant, Stress Corrosion Resistant 7050 Aluminum Alloy Plate" (Jan. 21, 2003).

(Continued)

*Primary Examiner*—Essama Omgba
(74) *Attorney, Agent, or Firm*—Novak Druce + Quigg, LLP

(57) ABSTRACT

A method for producing an integrated monolithic aluminum structure, including the steps of: (a) providing an aluminum alloy plate from an aluminum alloy with a predetermined thickness (y), (b) shaping or forming the alloy plate to obtain a predetermined shaped structure, (c) heat-treating the shaped structure, (d) machining, e.g. high velocity machining, the shaped structure to obtain an integrated monolithic aluminum structure.

21 Claims, 2 Drawing Sheets

U.S. PATENT DOCUMENTS

| | | | | | |
|---|---|---|---|---|---|
| 3,568,491 | A | * | 3/1971 | Bruner et al. | 72/364 |
| 3,850,763 | A | * | 11/1974 | Zinnbauer et al. | 205/206 |
| 3,945,861 | A | * | 3/1976 | Anderson et al. | 148/690 |
| 4,305,763 | A | * | 12/1981 | Quist et al. | 148/502 |
| 4,406,717 | A | * | 9/1983 | Vernam et al. | 148/440 |
| 4,410,370 | A | * | 10/1983 | Baba et al. | 148/535 |
| 4,412,870 | A | * | 11/1983 | Vernam et al. | 148/691 |
| 4,462,843 | A | * | 7/1984 | Baba et al. | 148/693 |
| 4,477,292 | A | * | 10/1984 | Brown | 148/502 |
| 4,569,703 | A | * | 2/1986 | Baba et al. | 148/417 |
| 4,589,932 | A | * | 5/1986 | Park | 148/690 |
| 4,629,517 | A | * | 12/1986 | Lifka et al. | 148/695 |
| 4,711,762 | A | * | 12/1987 | Vernam et al. | 420/532 |
| 4,806,174 | A | * | 2/1989 | Cho et al. | 148/693 |
| 4,832,758 | A | * | 5/1989 | Brown | 148/695 |
| 4,863,528 | A | * | 9/1989 | Brown et al. | 148/695 |
| 4,961,792 | A | * | 10/1990 | Rioja et al. | 148/552 |
| 5,047,092 | A | * | 9/1991 | Faure | 148/439 |
| 5,108,520 | A | * | 4/1992 | Liu et al. | 148/701 |
| RE34,008 | E | * | 7/1992 | Quist et al. | 148/417 |
| 5,137,686 | A | * | 8/1992 | Rioja et al. | 420/528 |
| 5,236,525 | A | * | 8/1993 | Anton | 148/564 |
| 5,312,498 | A | * | 5/1994 | Anderson | 148/695 |
| 5,496,426 | A | * | 3/1996 | Murtha | 148/691 |
| 5,560,789 | A | * | 10/1996 | Sainfort et al. | 148/549 |
| 5,632,827 | A | * | 5/1997 | Fujita et al. | 148/688 |
| 5,690,758 | A | * | 11/1997 | Oh et al. | 148/700 |
| 5,785,776 | A | * | 7/1998 | Sircar | 148/690 |
| 5,785,777 | A | * | 7/1998 | Cantrell et al. | 148/694 |
| 5,865,911 | A | * | 2/1999 | Miyasato et al. | 148/439 |
| 6,027,582 | A | * | 2/2000 | Shahani et al. | 148/417 |
| 6,315,842 | B1 | * | 11/2001 | Shahani et al. | 148/417 |
| 6,316,842 | B1 | | 11/2001 | Kuroda et al. | |
| 6,322,647 | B1 | * | 11/2001 | Kamat et al. | 148/690 |
| 6,544,358 | B1 | * | 4/2003 | Carr et al. | 148/440 |
| 6,569,542 | B2 | * | 5/2003 | Warner et al. | 428/544 |
| 6,606,895 | B2 | * | 8/2003 | Sanada et al. | 72/334 |
| 6,619,094 | B2 | * | 9/2003 | Juhl | 72/296 |
| 6,692,589 | B2 | * | 2/2004 | Warner et al. | 148/549 |
| 6,790,407 | B2 | * | 9/2004 | Fridlyander et al. | 420/532 |
| 6,973,815 | B2 | * | 12/2005 | Bryans et al. | 72/340 |
| 7,213,434 | B2 | * | 5/2007 | Sato | 72/354.8 |
| 2002/0150498 | A1 | * | 10/2002 | Chakrabarti et al. | 420/532 |
| 2003/0140990 | A1 | * | 7/2003 | Ribes et al. | 148/552 |
| 2004/0099352 | A1 | * | 5/2004 | Gheorghe et al. | 148/550 |
| 2005/0006010 | A1 | * | 1/2005 | Benedictus et al. | 148/552 |
| 2005/0034794 | A1 | * | 2/2005 | Benedictus et al. | 148/552 |
| 2005/0058568 | A1 | * | 3/2005 | Boselli et al. | 420/531 |
| 2005/0072497 | A1 | * | 4/2005 | Eberl et al. | 148/439 |
| 2005/0217770 | A1 | * | 10/2005 | Lequeu et al. | 148/698 |
| 2005/0271543 | A1 | * | 12/2005 | Pfannen-Mueller et al. | 420/532 |
| 2006/0065331 | A1 | * | 3/2006 | Bes et al. | 148/552 |
| 2006/0083654 | A1 | * | 4/2006 | Chakrabarti et al. | 420/532 |
| 2006/0157172 | A1 | * | 7/2006 | Fischer et al. | 148/690 |
| 2006/0174980 | A1 | * | 8/2006 | Benedictus et al. | 148/552 |

FOREIGN PATENT DOCUMENTS

| | | | | |
|---|---|---|---|---|
| EP | 1045043 | | | 10/2000 |
| GB | 2352453 | | | 1/2001 |
| JP | 51056719 | A | * | 5/1976 |
| JP | 2000178704 | A | * | 6/2000 |
| WO | 9824940 | | | 6/1998 |
| WO | WO 2004083478 | A1 | * | 9/2004 |

OTHER PUBLICATIONS

ASM Specialty Handbook Aluminum and Aluminum Alloys, ASM Int'l pp. 309-320 (1993).

Polytechnical Dictionary, ed. by A. Yu. Ishlinsky, Moscow, "Soviet Encyclopaedia" Publisher, p. 362 (1989).

J.E. Hatch, Aluminum Properties and Physical Metallurgy, Moscow, "Metallurgy" Publisher, pp. 132-133 (1984).

J.E. Hatch, Aluminum Properties and Physical Metallurgy, USA, "American Society For Metals" Publisher, pp. 132-133 (1984).

Office Action, Russian patent application No. 2005131942/02(035803), Nov. 16, 2007.

Machine translation for JP 2000178704, from Japanese Patent Office, published Jun. 27, 2000.

International Alloy Designations and Chemical Composition Limits for Wrought Aluminum and Wrought Aluminum Alloys, The Aluminum Association, p. 18 (Jan. 2001).

ASM Specialty Handbook, Aluminum and Aluminum Alloys, J. Davis, ed., pp. 29-30 and 59-62, ASM International (1993).

Bibliographic data for JP 2000178704, from European Patent Office, URL<http://v3.espacenet.com/publicationDetails/biblio?adjacent=true&KC=A&date=20000627&NR=2000178704A&DB=EPODOC&locale=en_EP&CC=JP&FT=D>, retrieved from Internet Mar. 23, 2009, published Jun. 27, 2000.

* cited by examiner

METHOD FOR PRODUCING AN INTEGRATED MONOLITHIC ALUMINUM STRUCTURE AND ALUMINUM PRODUCT MACHINED FROM THAT STRUCTURE

This application claims priority under 35 USC Section 119 from European Patent Application No. EP-03075764.5 filed on 17 Mar. 2003 and U.S. Provisional Patent Application No. 60/456,253 filed on 21 Mar. 2003, both of which are incorporated herein by reference in their entirety.

FIELD OF THE INVENTION

The present invention relates to a method for producing an integrated aluminum structure from an aluminum alloy, and an aluminum product produced from such an integrated aluminum structure. More specifically, the present invention relates to a method for producing structural aeronautical members from high strength, high toughness, corrosion resistant aluminum alloys designated by the AA7000-series of the international nomenclature of the Aluminum Association ("AA") for structural aeronautical applications. Even more specifically, the present invention relates to new methods for producing integrated aluminum structures for aeronautical applications which combine sheet and plate members within one integrated monolithic structure thereby avoiding distortion due to beneficial artificial ageing procedures.

DESCRIPTION OF THE RELATED ART

It is known in the art to use heat-treatable aluminum alloys in a number of applications involving relatively high strength, high toughness and corrosion resistance requirements such as aircraft fuselages, vehicular members and other applications. Aluminum alloys AA7050 and AA7150 exhibit high strength in T6-type tempers, see e.g. U.S. Pat. No. 6,315,842 incorporated herein by reference. Also precipitation-hardened AA7x75 and AA7x55 alloy products exhibit high strength values in the T6 temper. The T6 temper is known to enhance the strength of the alloy product and therefore finds application in particular in the aircraft industry. It is also known to artificially age the pre-assembled structures of an aircraft in order to enhance the corrosion resistance since the typical applications result in exposure to a wide variety of climatic conditions necessitating careful control of working and ageing conditions to provide adequate strength and resistance to corrosion, including both stress corrosion and exfoliation.

It is therefore known to artificially over-age these AA7000-series aluminum alloys. When artificially aged to a T79, T76, T74 or T73-type temper their resistance to stress corrosion, exfoliation corrosion and fracture toughness improve in the order stated (of these tempers the T73 being the best and T79 being close to T6). An acceptable temper condition is the T74 or T73-type temper thereby obtaining an acceptable balanced level of tensile strength, stress corrosion resistance, exfoliation corrosion resistance and fracture toughness.

When producing structural parts of an aircraft such as an aircraft fuselage which consists of stringers, e.g. cabin stringers or fuselage stringers, or beams as well as skin, both fuselage skin or cabin skin, it is known in the art to connect the stringers or beams to an aluminum alloy sheet, which constitutes, e.g., fuselage skin, with rivets or by means of welding. An aluminum alloy sheet is bent and formed in accordance with, e.g., the fuselage shape of an aircraft and connected to the stringers and beams or ribs by means of welding and/or throughout the use of rivets. The purpose of the stringers and ribs is to support and stiffen the finished structure.

In order to accelerate the production of aircraft and due to the need of reducing costs and accelerating production time it is also known to produce an aluminum alloy plate having a thickness in the range of 15 to 70 mm and to bend the plate which has a thickness equal to or greater than the thickness of the sheet constituting the aircraft fuselage skin and the height of the stringers or beams. After the bending operation the stringers are machined from the plate, thereby milling the aluminum material from in between the stringers.

Such prior art techniques display at least two major disadvantages. Firstly, the plate, which has been produced from an aluminum alloy which has been artificially aged as mentioned above in order to enhance the corrosion resistance, displays considerable distortion after the bending and machining operation thereby showing a vertical and horizontal distortion which makes the assembly of the aircraft fuselage or aircraft wing cumbersome since all parts need additional correction bending and measurement operations. Secondly, the bent and machined structure comprising sheet and stringers or beams displays residual or inner stress originating from such bending operation and resulting in regions or parts of the structure having a microstructure different from other regions with less or more internal residual stress. Those regions with an elevated level of internal residual stress tend to be more considerably susceptible to corrosion and fatigue crack propagation.

SUMMARY OF THE INVENTION

It is therefore an object of the present invention to provide a method of producing an integrated monolithic aluminum structure and an aluminum product machined from that structure which does not have one or more of the aforementioned disadvantages thereby providing structural members for aircraft or other applications which are easier and less expensive to assemble, which display no or at least lesser distortion after machining and which further have a more uniform microstructure thereby avoiding regions of differing inner stress levels.

More specifically, it is an object of the present invention to provide a method for producing an integrated monolithic aluminum structure for aeronautical applications which may be used to assemble an aircraft faster than with prior art aluminum structures and achieving better properties such as strength, toughness and corrosion resistance.

The present invention meets one or more of these objects by the method of producing an integrated monolithic aluminum structure, comprising the steps of: (a) providing an aluminum alloy plate from an aluminum alloy with a predetermined thickness (y), (b) shaping or forming the alloy plate to obtain a predetermined shaped structure having a built-in radius, (c) heat-treating the shaped structure, (d) optionally machining, e.g. high velocity machining, the shaped structure in order to obtain an integrated monolithic aluminum structure. Further preferred embodiments are described and specified by this specification.

In a further aspect of the invention there is provided an aluminum product produced from an integrated aluminum structure produced in accordance with the method of this invention, and wherein the shaped structure is machined in order to obtain an integrated aluminum structure with a base sheet and components. Preferred embodiments are described and specified by this specification.

DETAILED DESCRIPTION OF THE PREFERRED EMBODIMENTS

As will be appreciated herein below, except otherwise indicated, alloy designations and temper designations refer to the aluminum association designations in Aluminum Standards and Data and the Registration Records, as published by the Aluminum Association.

"Monolithic" is a term known in the art meaning comprising a substantially single unit which may be a single piece formed or created without joint or seams and comprising a substantially uniform whole. The monolithic product obtained by the process of the present invention may be undifferentiated, i.e., formed of a single material, and it may comprise integral structures or features such as a substantially continuous skin having an outer surface or side and an inner surface or side, and integral support members such as ribs or thickened portions comprising frame members on the inside surface of the skin.

One or more of the above mentioned objects of the present invention are achieved by preparing an aluminum alloy plate from an aluminum alloy with a predetermined thickness, shaping the alloy plate to obtain a predetermined shaped structure, preferably thereafter artificially or naturally ageing or annealing the shaped structure and then milling or machining, e.g. via high velocity machining, the shaped structure in order to obtain an integrated monolithic aluminum structure which can be used for the aforementioned purposes.

Since the ageing step or annealing is performed after the shaping step it is possible to obtain structural members having considerably reduced levels of distortion or are even essentially distortion-free making the resultant products in particular suitable for aircraft fuselage or wing applications or for a vertical skin with vertical spars for the tail of an aircraft. It is believed that the shaped structure, which displays the aforementioned disadvantages due to the shaping step, releases its inner stress or residual throughout the artificially or naturally ageing step which is performed after the shaping step of the alloy plate.

In a preferred embodiment of the method according to the invention after the shaping operation of the aluminum alloy plate into a predetermined shaped structure prior to any machining operation, e.g. by means of high velocity machining, the predetermined shaped structure is being artificially aged resulting in an improved dimensional stability during subsequent machining operations. Preferably, the shaped structure is being artificially aged to a temper selected from the group comprising T6, T79, T78, T77, T76, T74, T73 and T8 temper condition. By means of example, a suitable T73 temper would be the T7351 temper, and a suitable T74 temper would be the T7451 temper.

In an embodiment of the method, the shaping or forming process to obtain a predetermined shaped structure comprises a cold forming operation, e.g. a bending operation resulting in a product having a built-in radius.

In an embodiment of the method according to the invention the aluminum alloy plate prior to the shaping or forming operation has been stretched after quenching from the solution heat-treatment temperature. Preferably, the stretching operation involves not more than 8% of the length just prior to the stretching operation, and is preferably in a range of 1 to 5%. Typically this is achieved by bringing the aluminum alloy plate in a T4 or a T73 or T74 or T76 temper, such as a T451 temper or a T7351 temper.

The shaped structure has preferably a pre-machining thickness equal to or greater than the combined thickness of a base sheet or skin and additional components, e.g. stringers, wherein said base sheet and additional components form said integrated monolithic aluminum structure.

The distortion in the longitudinal direction of the obtained product is typically less than 0.13 mm, and preferably less than 0.10 mm when measured in accordance with the BMS 7-323D, section 8.7.

In an embodiment the pre-machining thickness (y) of the shaped structure is in the range of 10 to 220 mm, preferably in the range of 15 to 150 mm, and more preferably in the range of 20 to 100 mm, and most preferably in the range of 30 to 60 mm.

The aluminum alloy plate is preferably made from an aluminum alloy selected from the group consisting of AA5xxx, AA7xxx, AA6xxx and AA2xxx-series aluminum alloys. Particular examples are those within the AA7x50, AA7x55, AA7x75, and AA6x13-series aluminum alloys, and typical representatives of these series are AA7075, AA7475, AA7010, AA7050, AA7150 and M6013 alloys.

In accordance with a preferred embodiment of the present invention the aluminum alloy plate is prepared from an aluminum alloy that has been stretched after quenching. An example is given as follows:

A preferred method for producing an AA7xxx-series aluminum alloy for plate applications in the field of aerospace with balanced high toughness and good corrosion properties comprises the steps of working a body having a composition consisting of, in weight %:

| | |
|---|---|
| Zn | 5.0-8.5 |
| Cu | 1.0-2.6 |
| Mg | 1.0-2.9 |
| Fe | <0.3, preferably <0.15 |
| Si | <0.3, preferably <0.15, |

optionally one or more elements selected from

| | |
|---|---|
| Cr | 0.03-0.25 |
| Zr | 0.03-0.25 |
| Mn | 0.03-0.4 |
| V | 0.03-0.2 |
| Hf | 0.03-0.5 |
| Ti | 0.01-0.15, |

the total of the optional elements not exceeding 0.6 weight %, the balance aluminum and incidental impurities each <0.05%, and the total <0.20%, solution heat treating and quenching the product, stretching the quenched product by 1% to 5%, and preferably 1.5% to 3%, to arrive at a T451 temper, and thereafter shaping the product, e.g. by means of bending, pre-curving or milling, in order to obtain the predetermined shaped structure.

The predetermined shaped structure is then preferably artificially aged by either heating the product up to three times in a row to one or more temperatures from 79° C. to 165° C. or heating the predetermined shaped structure first to one or more temperatures from 79° C. to 145° C. for two hours or more or heating the shaped structure to one or more temperatures from 148° C. to 175° C. Thereafter, the shaped structure does not display any substantial distortion and—at the same time—the shaped structure shows an improved exfoliation corrosion resistance of "EB" or better measured in accordance with ASTM G34-97 and with about 15% greater yield strength than similar sized AA7x50 alloy counter-parts in the T76-temper condition.

According to AMS 2772C typical ageing practice to arrive at the T7651 temper for the AA7050 alloy involves 3 to 6 hours at 121° C. followed by 12 to 15 hours at 163° C., whereas for the same alloy arriving at the T7451 temper involves 3 to 6 hours at 121° C. followed by 20 to 30 hours at 163° C. Typical ageing practice to arrive at the T7351 temper for the AA7475 alloy involves 6 to 8 hours at 121° C. followed by 24 to 30 hours at 163° C. And typical ageing practice for the AA7150 alloy to arrive at the T651 temper involves 24 hours at 121° C. or 24 hours at 121° C. followed by 12 hours at 160° C.

In a preferred embodiment of the product according to the invention, the base sheet is a fuselage skin of an aircraft and said components are at least parts of integral stringers or other integral reinforcements of the fuselage of an aircraft, and wherein the fuselage has a built-in radius.

In another embodiment the base sheet is the base skin of an integrated structure like an integrated door and the components are at least parts of the integral reinforcements of the integrated structure of an aircraft, and wherein the integrated structure has a built-in radius.

In another embodiment said base sheet is a wing skin of an aircraft, the components are at least parts of integrated ribs and/or other integrated reinforcements such a stringers of a wing of an aircraft.

BRIEF DESCRIPTION OF THE DRAWINGS

The foregoing and other features and advantages of the method and aluminum alloy product according to the present invention will become readily apparent from the following detailed description of an embodiment as further described by the appended drawings:

FIG. 1 shows an integrated aluminum structure comprising a base sheet 1 and additional components 2 such as stringers or beams for aircraft applications. The integrated aluminum structure 6 consists of a pre-curved base sheet 1 which is shaped in accordance with the shape of, e.g. an aircraft fuselage, thereby showing the cross-section of a fuselage skin 1. The additional components 2 are, e.g. stringers attached to the base sheet 1—in accordance with prior art techniques—e.g. by rivets and/or by welding.

FIG. 2 shows the distortion effects of an integrated aluminum structure that has been produced in accordance with a prior art method. When the additional components 2 are attached to the base sheet 1 and when the whole structure is finished after the machining and riveting or welding step, a horizontal distortion $d_1$ and/or a vertical distortion $d_2$ usually results from stress relief from the pre-curved plate or sheet which has been bent before additional components 2 are connected to the base sheet 1 or before components 2 are machined from a plate product with a corresponding thickness.

FIG. 3*a* shows an integrated monolithic structure or component manufactured also according to the prior art. An aluminum alloy block 3 is produced by casting, homogenizing, hot working by rolling, forging or extrusion and/or cold working, solution heat treatment, quenching and stretching, thereby obtaining a thick aluminum alloy block 3 which is "shaped" to obtain a predetermined shaped structure 5. The shaping step is a mechanical milling or machining step thereby milling the aluminum alloy block 3 and obtaining a predetermined shaped structure 5 with a predetermined thickness y as shown in FIG. 3*c*. The predetermined thickness y is equal to or greater than the sheet thickness x of the base sheet 1 and the extension of the additional components 2 which are—by one or more further milling steps—machined from the shaped structure 5 after the ageing step. A disadvantage with this approach is that there may be significant residual stress in the product, and this may lead amongst others to increasing the cross-section of frame members or the skin itself to meet required tolerances and safety requirements.

FIG. 3*b* shows an embodiment of the present invention wherein the shaping step is a mechanical bending step thereby bending an alloy plate 4 into a bent or pre-curved structure 5 having a built-in radius shown in FIG. 3*c*. Using the method according to this invention also double-curved structures can be made, e.g. having a parabolic structure. An advantage of this embodiment of the present invention compared to the prior art described with FIG. 3*a* is amongst others that less aluminum is used for machining or milling since the predetermined thickness y of the alloy plate 4 is considerably smaller than a predetermined thickness of the whole aluminum block 3. Further by an ageing step after the shaping, it is possible to obtain essentially distortion-free structural members suitable for, e.g., aircraft fuselage and wing applications. Another advantage of the method and the product of the present invention is that it provides a thinner final monolithic product or structure that has strength and weight advantages over thicker type products produced over conventional methods. This means that designs with thinner walls and less weight may be provided and approved for use. Yet another advantage of the method and the product of the present invention is the weight reduction of the monolithic part. Weight is further reduced also by the possible elimination of fasteners. This is related to the accuracy advantages in the machining operation resulting from the reduced distortion, and the inherent accuracy of final machining after forming.

EXAMPLE

Figure 1:
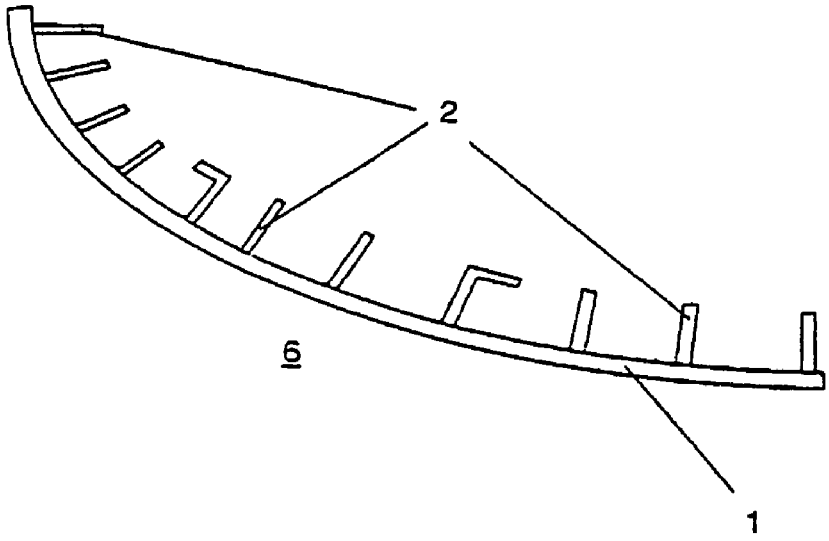
Fig. 1 (Prior Art)
FIG. 1 shows an integrated aluminum structure.
Figure 2:
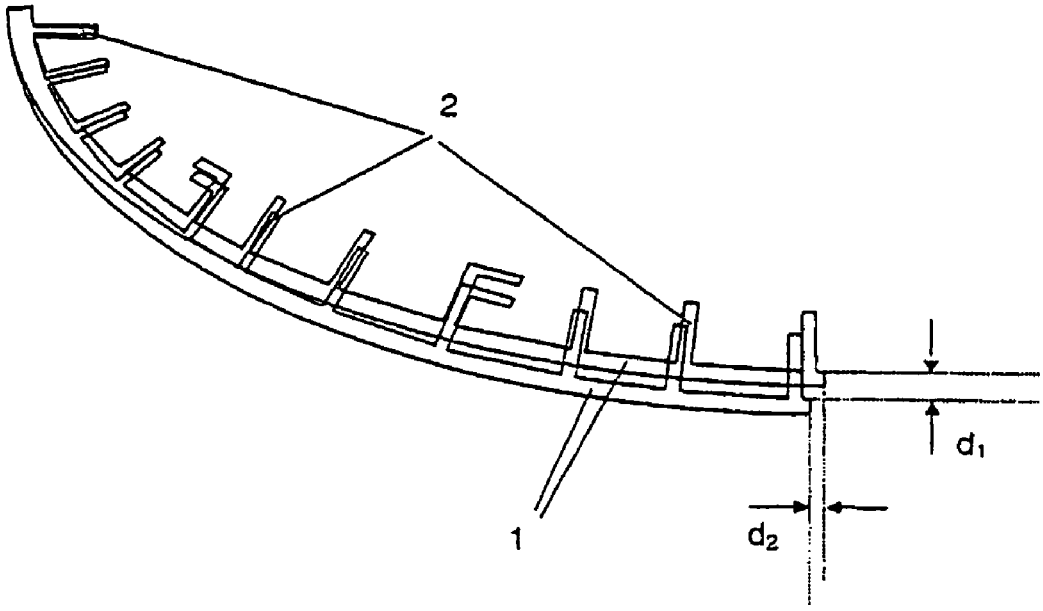
Fig. 2 (Prior Art)
FIG. 2 shows distortion effects of the integrated aluminum structure of FIG. 1.
Figure 3A:
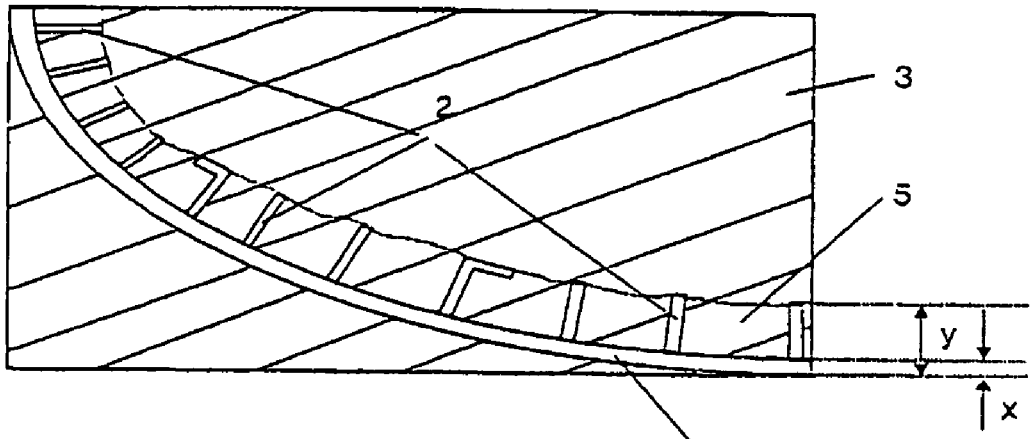
Fig. 3a (Prior Art)
FIG. 3*a* shows an embodiment of the prior art.
Figure 3B:
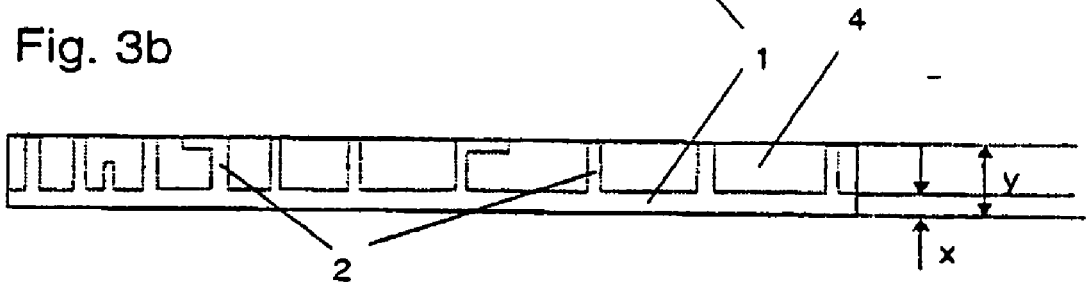
FIG. 3*b* shows an embodiment of the present invention.
Figure 3C:
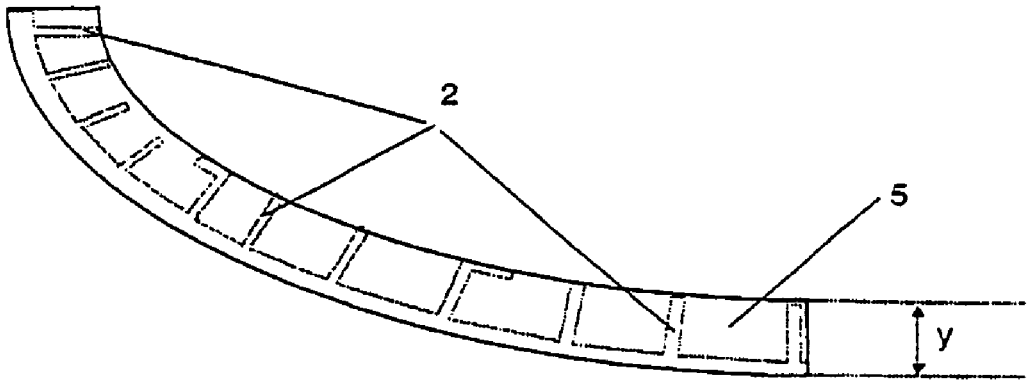
FIG. 3*c* shows a shaped structure (5) artificially or naturally aged in accordance with the present invention.

On an industrial scale thick plates have been manufactured of the AA7475-series alloy (aerospace grade material) having final dimensions of 40 mm thickness, a width of 1900 mm, and a length of 2000 mm. Different plates have been brought to the T451 temper condition and the T7351 temper condition in a known manner.

In one method of manufacturing integrated monolithic structures, a plate in the T451 temper has been bent in its L-direction to a structure with a radius of 1000 mm followed by artificial ageing to the T7351 temper. The distortion in the longitudinal direction was in the range of 0.07 to 0.09 mm, which can be calculated in a known manner to a residual stress in longitudinal direction in the range of 16 to 22 MPa.

In another method of manufacturing integrated structures, a plate in the T7351 temper has been bent in its L-direction to a structure with a radius of 1000 mm without further ageing treatment. The distortion in the longitudinal direction was in the range of 0.15 to 0.22 mm, which can be calculated in a known manner to a residual stress in longitudinal direction in the range of 49 to 54 MPa. For both methods the distortion after machining has been measured in accordance with the BMS 7-323D, section 8.7, revised version of 21 Jan. 2003, and incorporated herein by reference.

This example shows amongst others the beneficial influence of the ageing treatment after forming a curved panel and prior to machining into an integrated structure on the distortion after machining and thereby on the residual stresses in the material.

Having now fully described the invention, it will be apparent to one of ordinary skill in the art that many changes and modifications can be made without departing from the spirit or scope of the invention as hereon described.

The invention claimed is:

1. A method for manufacturing an aeronautical member, comprising the steps of:

a.) providing an aluminum alloy plate with a predetermined thickness, said plate having been stretched after quenching and having been brought to a first temper selected from the group consisting of T4, T73, T74 and T76, wherein said aluminum alloy plate is produced from a AA7xxx-series aluminium alloy having a composition consisting of, in weight percent:

| | |
|---|---|
| Zn | 5.0-8.5 |
| Cu | 1.0-2.6 |
| Mg | 1.0-2.9 |
| Fe | <0.3 |
| Si | <0.3 |

optionally one or more elements selected from:

| | |
|---|---|
| Cr | 0.03-0.25 |
| Zr | 0.03-0.25 |
| Mn | 0.03-0.4 |
| V | 0.03-0.2 |
| Hf | 0.03-0.5 |
| Ti | 0.01-0.15, |

the total of the optional elements not exceeding 0.6, incidental impurities each <0.05, total <0.20;

the balance aluminium, b.) shaping said alloy plate to obtain a predetermined shaped structure having a pre-machining thickness in the range of 10 to 220 mm, wherein said shaping comprises cold forming, wherein said cold forming comprises bending said alloy plate in said first temper selected from the group consisting of T4, T73, T74 and T76 to form the shaped structure having a built-in radius, c.) heat-treating said shaped structure, wherein said heat-treating comprises artificially aging said shaped structure to a second temper selected from the group consisting of T6, T79, T78, T77, T76, T74, T73 or T8, d.) machining said shaped structure to obtain an integrated monolithic aluminum structure as said aeronautical member for an aircraft, wherein said machining of said shaped structure occurs after said artificial ageing.

2. The method according to claim 1, wherein said aluminum alloy plate has been stretched in a range of up to 8% after quenching prior to the shaping step.

3. The method according to claim 1, wherein said aluminum alloy plate has been stretched in a range of up to 1 to 5% after quenching prior to the shaping step.

4. The method according to claim 1, wherein said aluminum alloy plate is produced from an aluminum alloy selected from the group of AA7x50, AA7x55, and AA7x75 series alloys.

5. The method according to claim 1, wherein said shaped structure has a pre-machining thickness in the range of 15 to 150 mm.

6. The method according to claim 1, wherein said shaped structure has a pre-machining thickness in the range of 30 to 60 mm.

7. The method according to claim 1, wherein the integrated monolithic aluminum structure has a distortion in its longitudinal direction of less than 0.13 mm when measured according to BMS 7-323D, section 8.7.

8. The method according to claim 1, wherein the integrated monolithic aluminum structure has a distortion in its longitudinal direction of less than 0.10 mm when measured according to BMS 7-323D, section 8.7.

9. The method according to claim 1, wherein said aluminum alloy plate is produced from an aluminum alloy having a composition consisting of, in weight percent:

| | |
|---|---|
| Zn | 5.0-8.5 |
| Cu | 1.0-2.6 |
| Mg | 1.0-2.9 |
| Fe | <0.15 |
| Si | <0.15, |

optionally one or more elements selected from:

| | |
|---|---|
| Cr | 0.03-0.25 |
| Zr | 0.03-0.25 |
| Mn | 0.03-0.4 |
| V | 0.03-0.2 |
| Hf: | 0.03-0.5 |
| Ti | 0.01-0.15, |

the total of said optional elements not exceeding 0.6, incidental impurities each <0.05, total <0.20 the balance aluminum.

10. An integrated monolithic aluminum structure produced in accordance with the method according to claim 1, wherein said shaped structure is machined to obtain the integrated monolithic aluminum structure with a base sheet and integral components, wherein the integrated monolithic aluminum structure has a distortion in its longitudinal direction of less than 0.13 mm when measured according to BMS 7-323D, section 8.7 and a lack of regions of differing inner stress levels, wherein said base sheet is a wing skin of an aircraft, said components are at least parts of integral ribs or other integral reinforcements of a wing of an aircraft.

11. The monolithic aluminum structure according to claim 10, wherein the integrated monolithic aluminum structure has a distortion in its longitudinal direction of less than 0.10 mm when measured according to BMS 7-323D, section 8.7.

12. The monolithic aluminum structure according to claim 11, wherein the integrated monolithic aluminum structure has an exfoliation resistance of EB or better measured according to ASTM G34-97.

13. The monolithic aluminum structure according to claim 11, wherein the aluminum alloy plate has a T451 temper and the integrated monolithic aluminum structure has a T7351 temper and the distortion in the longitudinal direction of the monolithic aluminum structure was less than 0.09 mm.

14. The method according to claim 1, wherein said heat treatment of said shaped structure comprises an annealing treatment.

15. The method according to claim 1, wherein said heat treatment of said shaped structure comprises artificial ageing in the range from about 79 to 175° C.

16. The method according to claim 1, wherein said aeronautical member is a structural part of an aircraft.

17. The method according to claim 16, wherein said structural part of an aircraft comprises stringers and skin, wherein the stringers are integrally connected to the skin.

18. The method according to claim 1, wherein said machining of said shaped structure obtains said integrated monolithic aluminum structure for part of a wing skin or a frame portion as said aeronautical member for an aircraft.

19. The method according to claim 1, wherein the first temper is T4 and the second temper is selected from the group consisting of T6, T79, T78, T77, T76, T74, T73 and T8.

20. The method according to claim 1, wherein the first temper is selected from the group consisting of T73, T74 and T76 and the second temper is selected from the group consisting of T6, T79, T78, T77 and T8.

21. The method according to claim 1, wherein the first temper is selected from the group consisting of T73, T74 and T76 and the second temper is selected from the group consisting of T79, T78, T77 and T8.

* * * * *